US009103633B2

(12) United States Patent
Holowczak et al.

(10) Patent No.: US 9,103,633 B2
(45) Date of Patent: Aug. 11, 2015

(54) LIGHTWEIGHT PROJECTILE RESISTANT ARMOR SYSTEM

(75) Inventors: John E. Holowczak, South Windsor, CT (US); Connie E. Bird, Rocky Hill, CT (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 2595 days.

(21) Appl. No.: 11/682,390

(22) Filed: Mar. 6, 2007

(65) Prior Publication Data

US 2008/0271595 A1 Nov. 6, 2008

Related U.S. Application Data

(60) Provisional application No. 60/794,276, filed on Apr. 20, 2006.

(51) Int. Cl.
*F41H 5/00* (2006.01)
*F41H 5/04* (2006.01)

(52) U.S. Cl.
CPC ..... *F41H 5/0414* (2013.01)

(58) Field of Classification Search
USPC ..... 89/36.01, 36.02, 36.04, 36, 36.087, 89/36.07, 36.08
See application file for complete search history.

(56) References Cited

U.S. PATENT DOCUMENTS

| | | | | |
|---|---|---|---|---|
| 4,179,979 | A | | 12/1979 | Cook et al. |
| 4,398,446 | A | | 8/1983 | Pagano et al. |
| 4,739,690 | A | | 4/1988 | Moskowitz |
| 4,876,941 | A | | 10/1989 | Barnes et al. |
| 5,025,707 | A | | 6/1991 | Gonzalez |
| 5,060,553 | A | | 10/1991 | Jones |
| 5,179,244 | A | | 1/1993 | Zufle |
| 5,293,806 | A | | 3/1994 | Gonzalez |
| 5,349,893 | A | * | 9/1994 | Dunn ..... 89/36.05 |
| 5,402,703 | A | | 4/1995 | Drotleff |
| 5,443,882 | A | | 8/1995 | Park |
| 5,443,883 | A | | 8/1995 | Park |
| 5,516,595 | A | | 5/1996 | Newkirk et al. |
| 5,547,536 | A | | 8/1996 | Park |
| 5,576,508 | A | | 11/1996 | Korpi |
| 5,686,689 | A | | 11/1997 | Snedeker et al. |
| 5,918,309 | A | | 7/1999 | Bachner, Jr. |
| 6,009,791 | A | | 1/2000 | Medlin |
| 6,073,884 | A | | 6/2000 | Lavergne |

(Continued)

FOREIGN PATENT DOCUMENTS

| | | |
|---|---|---|
| EP | 0237095 | 9/1987 |
| EP | 0287918 | 10/1998 |
| FR | 2 723 193 | 2/1996 |
| FR | 2723193 | 2/1996 |
| WO | 03010484 | 2/2003 |

OTHER PUBLICATIONS

English Translation of French Publication No. 2 723 193, Feb. 2, 1996.

(Continued)

*Primary Examiner* — J. Woodrow Eldred
(74) *Attorney, Agent, or Firm* — Carlson, Gaskey & Olds P.C.

(57) ABSTRACT

An armor system with a lightweight armored panel manufactured as a multi-material structure having a multiple of layers including a hard ballistic material layer of a Ceramic/CMC (Ceramic Matrix Composite) hybrid armor material capable of defeating ballistic threats.

17 Claims, 4 Drawing Sheets

(56) References Cited

U.S. PATENT DOCUMENTS

| | | | |
|---|---|---|---|
| 6,253,655 | B1 | 7/2001 | Lyons et al. |
| 6,327,954 | B1 | 12/2001 | Medlin |
| 6,532,857 | B1 | 3/2003 | Shih et al. |
| 6,544,913 | B2 | 4/2003 | Kim et al. |
| 6,609,452 | B1 | 8/2003 | McCormick |
| 6,696,144 | B2 | 2/2004 | Holowczak et al. |
| 7,069,836 | B1 | 7/2006 | Palicka et al. |
| 7,077,306 | B2 | 7/2006 | Palicka et al. |
| 7,104,177 | B1 | 9/2006 | Aghajanian et al. |
| 2007/0116939 | A1 * | 5/2007 | Benitsch et al. ..... 428/292.1 |

OTHER PUBLICATIONS

B. Matchen, "Applications of Ceramics in Armor Products," Key Engineering Materials, vols. 122-124 (1996) pp. 333-342.

D.H. Laananen and K.L. Winkelman, "Analysis of energy-absorbing seat configurations for aircraft," IJCrash 1996 vol. 1 No. 4, p. 355-367.

International Search Report and Written Opinion dated Jun. 30, 2008.

* cited by examiner

LIGHTWEIGHT PROJECTILE RESISTANT ARMOR SYSTEM

The present invention claims the benefit of U.S. Provisional Patent Application No. 60/794,276, filed Apr. 20, 2006.

BACKGROUND OF THE INVENTION

The present invention relates to an armor system, and more particularly to a lightweight armored panel manufactured as a structure having multiple of layers including a hard ballistic material layer made of a Ceramic/CMC hybrid armor material capable of defeating high velocity Armor Piercing (AP) projectiles.

A variety of configurations of projectile-resistant armor are known. Some are used on vehicles while others are specifically intended to protect an individual. Some materials or material combinations have proven useful for both applications.

Accordingly, it is desirable to provide a lightweight armor system usable for a multiple of applications.

SUMMARY OF THE INVENTION

The armor system according to the present invention provides an armored panel manufactured as a structure having multiple layers. The armored panel generally includes a front face layer, a hard ballistic material layer, a compressed oriented fiber spall shield layer, and a backing layer. The front face layer and the backing layer are manufactured from a polymer matrix composite glass fabric laid up in a multiple of plies. The front face layer and the backing layer may be joined at the edges to hold the material stack together. The compressed oriented fiber spall shield layer acts as a spall shield to capture fragments and to reduce deflection in response to a projectile impact. The front face layer and the backing layer encapsulate the inner layers to form a mount structure as well as protect the inner layers from potential damage caused by environmental factors. The hard ballistic material layer is a Ceramic/CMC hybrid armor material. The compressed oriented fiber spall shield layer is to some degree flexible and further disperses the projectile impact load. The compressed oriented fiber spall shield layer also traps projectile and ceramic fragments.

The hard ballistic material layer includes a Ceramic Matrix Composite (CMC) layer bonded to a monolithic ceramic layer to form what is referred to herein as a Ceramic/CMC hybrid layer. The near perfect thermal expansion match between the CMC layer and the monolithic ceramic layer ensures that any pre-straining of the materials is minimized. A small compressive stress in the ceramic layer is desirable but not required. The CMC layer(s) are continuously bonded to the monolithic ceramic layer. The high modulus CMC layer(s) allows the compressive stress wave from a projectile impact to easily move from the monolithic ceramic layer through to the CMC layer(s) thereby effectively increasing the armor protection. Optional front face CMC layer(s) confine the monolithic ceramic layer and focuses the ejected plume of ceramic material pulverized by the projectile impact directly back at the projectile. Back face CMC layer(s) reinforces the back surface of the monolithic ceramic layer where the compressive stress wave reflects as a tensile stress wave. The CMC layer(s) further facilitates energy absorption from projectile impact through fiber debonding and pullout, as well as shear failure.

The lightweight armor system is capable of defeating Armor Piercing (AP) and Armor Piercing Incendiary (API) rounds which have very hard metal inserts. The ballistic resistant material is readily scalable to defeat more or less energetic rounds by adjusting the thickness of the CMC layer and ceramic layers.

The present invention therefore provides a lightweight armor system usable for a multiple of applications.

BRIEF DESCRIPTION OF THE DRAWINGS

The various features and advantages of this invention will become apparent to those skilled in the art from the following detailed description of the currently disclosed embodiment. The drawings that accompany the detailed description can be briefly described as follows.

DETAILED DESCRIPTION OF THE PREFERRED EMBODIMENT

Figure 1:
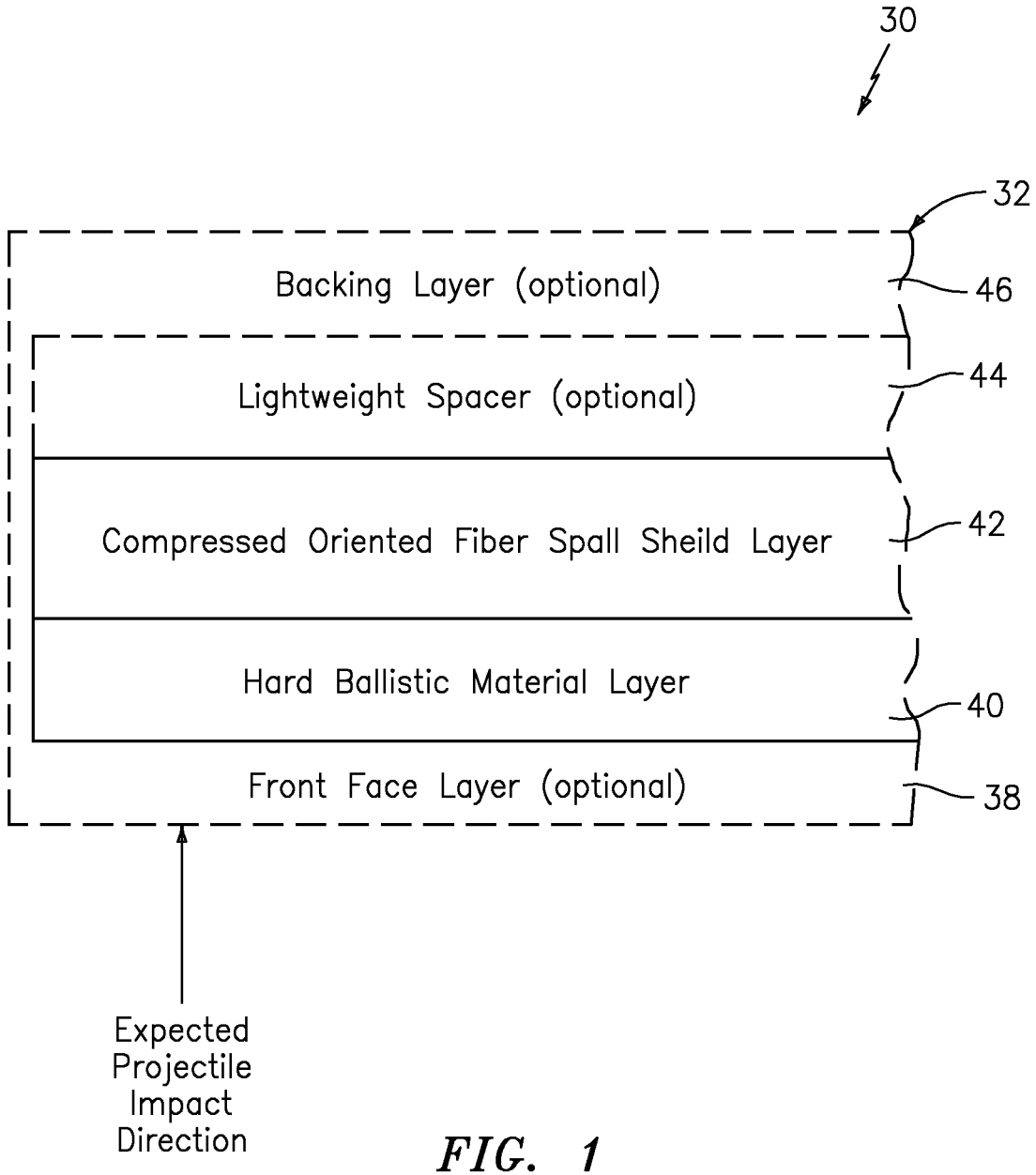
FIG. 1 is a sectional view of an armored panel illustrating the multiple of layers therein.

Referring to FIG. 1, an armor system 30 includes an armored panel 32 which is manufactured as a layered structure having a multiple materials some of which maybe bonded together. The armored panel 32 generally includes a front face layer 38 (optional), a hard ballistic material layer 40, a compressed oriented fiber spall shield layer 42, a spacer layer 44 (optional) and a backing layer 46 (optional). In one disclosed embodiment, the front face layer 38 is approximately 0.02 inches thick, the hard ballistic material layer 40 is approximately 0.35 inches thick, the compressed oriented fiber spall shield layer 42 is approximately 0.5 inches thick, the spacer layer 44 is approximately 0.22 inches thick, and the backing layer 46 is approximately 0.09 inches thick.

The front face layer 38 and the backing layer 46 are preferably manufactured from a polymer matrix composite glass fabric cloth such as fiberglass, S-2 Glass, IM Graphite, Low Mod Graphite, Kevlar or the like which is laid up in a multiple of plys as generally understood. Preferably, zero to three plys are utilized to form the front face layer 38 and from four to ten plys are utilized to form the backing layer 46. The backing layer 46 may be of increased thickness to stiffen the compressed oriented fiber spall shield layer 42 and reduce deflection in response to a projectile impact.

The front face layer 38, although potentially being absent, preferably includes at least one ply such that the front face layer 38 and the backing layer 46 may be utilized to encapsulate the inner layers 40-44. Such encapsulation further protects the inner layers 40-44 from potential damage caused by environmental factors.

The hard ballistic material layer 40 includes a Ceramic/CMC hybrid armor material as will be more fully described below. Generally, ceramic materials provide increased ballistic protection at a lower density as compared to metal alloys but may be more expensive to manufacture.

The compressed oriented fiber spall shield layer 42 is preferably a Dyneema®, Spectra® or Kevlar® material which provides polyethylene fibers that offer significant strength combined with minimum weight. The compressed oriented fiber spall shield layer 42 acts as a spall shield that traps projectile and ceramic fragments.

The spacer layer 44 is preferably a Nomex honeycomb core which may be utilized to increase the panel 32 depth to facilitate the mounting of the armored panel 32. It should be understood that the spacer layer 44 is optional and may not be utilized in particular armor systems such as, for example only, personal wearable body armor.

Figure 2:
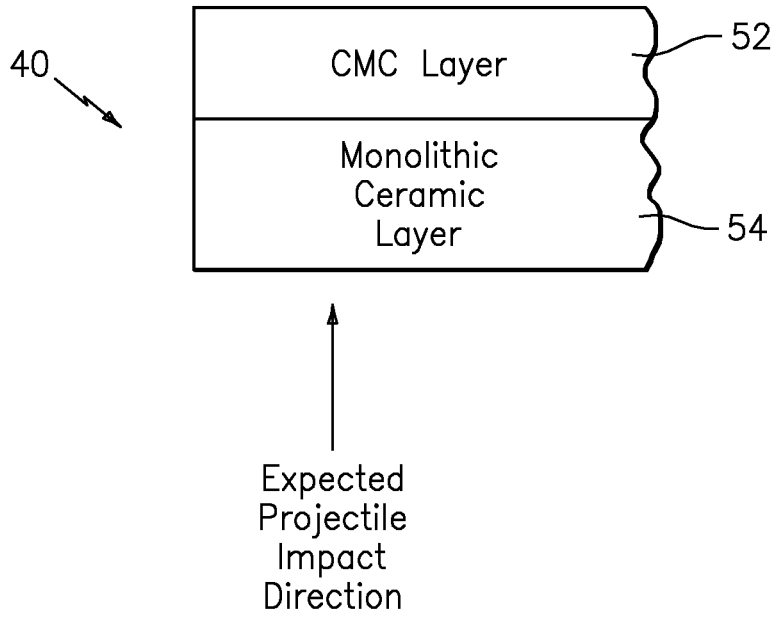
FIG. 2 is a sectional view of one embodiment of the hard ballistic material layer of the armored panel illustrated in FIG. 1.
Figure 3:
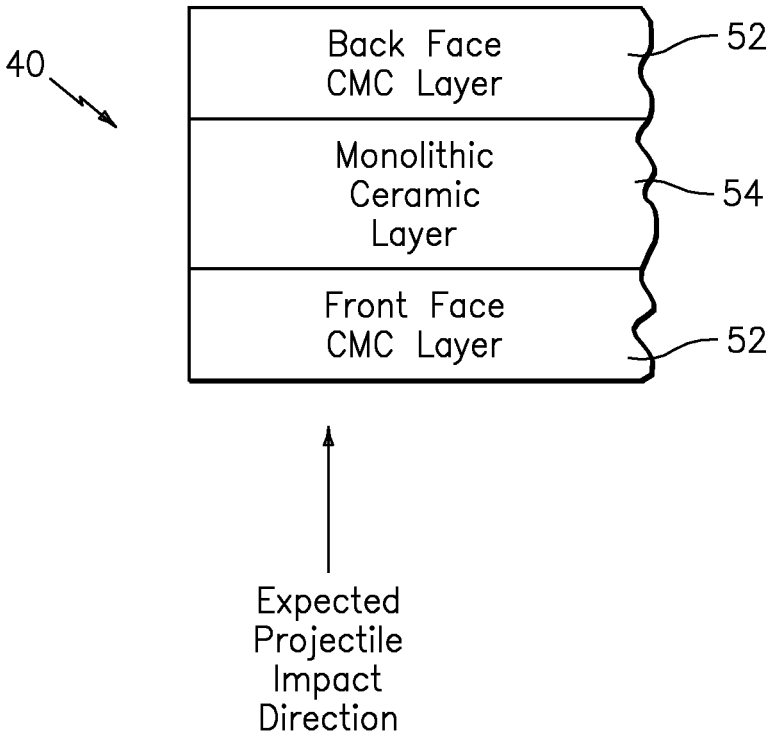
FIG. 3 is a sectional view of another embodiment of the hard ballistic material layer of the armored panel illustrated in FIG. 1.

Referring to FIG. 2, the hard ballistic material layer 40 preferably includes a Ceramic Matrix Composite (CMC) layer 52 bonded to a monolithic ceramic layer 54. The hard ballistic material layer 40 is also referred to herein as a Ceramic/CMC hybrid layer. The Ceramic Matrix Composite (CMC) layer 52 may alternatively be bonded to both a front face and a rear face of the monolithic ceramic layer 54 (FIG. 3). It should be understood that the terms "front face" and "rear face" are with reference to a direction which a projectile is expected to strike. The front face is struck first. The Ceramic/CMC hybrid armor preferably includes the CMC layer 52 continuously bonded to the monolithic ceramic layer 54.

The monolithic ceramic layer 54 may be, for example only, silicon nitride (Si.sub.3N.sub.4), silicon aluminum oxynitride (SiAlON), silicon carbide (SiC), silicon oxynitride (Si.sub.2N.sub.2O), aluminum nitride (AlN), aluminum oxide (Al.sub.2O.sub.3) hafnium oxide (HfO.sub.2), zirconia (ZrO.sub.2), siliconized silicon carbide (Si—SiC), Boron carbide or a combination thereof. It shall be understood that other oxides, carbides or nitrides may also be capable of withstanding ballistic impacts.

The CMC layer 52 generally includes a glass-ceramic matrix composite having a matrix and fiber reinforcement. The matrix typically includes a silicate capable of being crystallized. Examples of such silicates may include magnesium aluminum silicate, magnesium barium aluminum silicate, lithium aluminum silicate and barium aluminum silicate. The glass-ceramic matrix composite reinforcement typically includes a ceramic fiber capable of high tensile strength. Examples of such ceramic fibers comprise silicon carbide (SiC), silicon nitride (Si.sub.3N.sub.4) aluminum oxide (Al.sub.2O.sub.3), silicon aluminum oxynitride (SiAlON), aluminum nitride (AlN) and combinations thereof. The CMC layer 52 most preferably includes carbon coated silicon carbide fibers (Nicalon™) in an 8 harness satin weave, with a barium magnesium aluminum silicate "BMAS" matrix material which also operates as an adhesive between the CMC layer 52 and the monolithic ceramic layer 54 to provide the continuous bond therebetween.

The CMC layer 52 may be continuously bonded to the monolithic ceramic layer 54 by infiltrating a ceramic fiber mat or preform with either a matrix material or a matrix precursor. Specifically, such methods may include, (1) infiltrating a glass into a ceramic fiber mat or preform, which contacts the monolithic ceramic layer 54; (2) creating the matrix of CMC layer 52 by a chemical vapor infiltrated process while the CMC layer 52 is in contact with the monolithic ceramic layer 54; (3) forming the matrix of a CMC layer 52 by a polymer infiltration and pyrolysis process while a fibrous mat or preform contacts the monolithic ceramic layer 54; and (4) fabricating the CMC layer 52 and epoxy bonding the CMC layer 52 to the ceramic layer 54.

For further understanding of affixing the CMC layer 52 to the monolithic ceramic layer, attention is directed to U.S. Pat. No. 6,696,144 which is assigned to the assignee of the instant invention and which is hereby incorporated herein in its entirety.

The close thermal expansion match between the CMC layer 52 and the monolithic ceramic layer 54 face insures that any pre-straining of the materials is minimized. The high elastic modulus of the BMAS matrix, when compared to a typical polymer (e.g. epoxy) matrix used in conventional armor production, results in highly efficient transfer of incoming ballistic induced stress waves to the fiber matrix interfaces. The elastic modulus (stiffness) of the CMC layer 52 backing has a direct influence on the performance of the monolithic ceramic layer 54 and thus the armor panel 32 in total. That is, the higher the elastic modulus of the CMC layer 52, the more readily the CMC layer 54 will absorb some fraction of the project impact energy thereby resulting in an effective increase in the armor protection. Furthermore, the Nicalon fiber in the BMAS matrix readily debinds and the slip of the fibers through the matrix produces a Ceramic/CMC hybrid armor with high work of fracture to effectively absorb energy from the ballistic impact.

The high modulus CMC layer 52 (compared to conventional polymer matrix composites) allow the compressive stress wave from projectile impact to easily move from the monolithic ceramic layer 54 through to the CMC layer 52 of the Ceramic/CMC hybrid armor. The front face CMC layer (FIG. 3) confines the monolithic ceramic layer 52 and focuses the ejected plume of ceramic material pulverized by the projectile impact directly back at the projectile. The back face CMC layer 52 reinforces the back surface of the monolithic ceramic layer 54 where the compressive stress wave reflects as a tensile stress wave. The CMC layer 54 facilitates energy absorption from a projectile impact through fiber debonding and pullout, as well as shear failure.

Applicant has determined with testing performed using hardened steel balls fired at samples over a range of velocities and with modeling of the energy absorbed indicates that the CMC layer 52 is much more efficient than an un-reinforced ceramic plate. In addition, damage even at AP bullet velocities was highly localized such that Ceramic/CMC hybrid armor panels are effective against multiple ballistic impact situations.

The lightweight armor system is capable of defeating Armor Piercing (AP) and Armor Piercing Incendiary (API) rounds which have very hard metal inserts. The ballistic resistant material is scalable to defeat more or less energetic round by adjusting the thickness of the CMC and ceramic layers.

Figure 4:
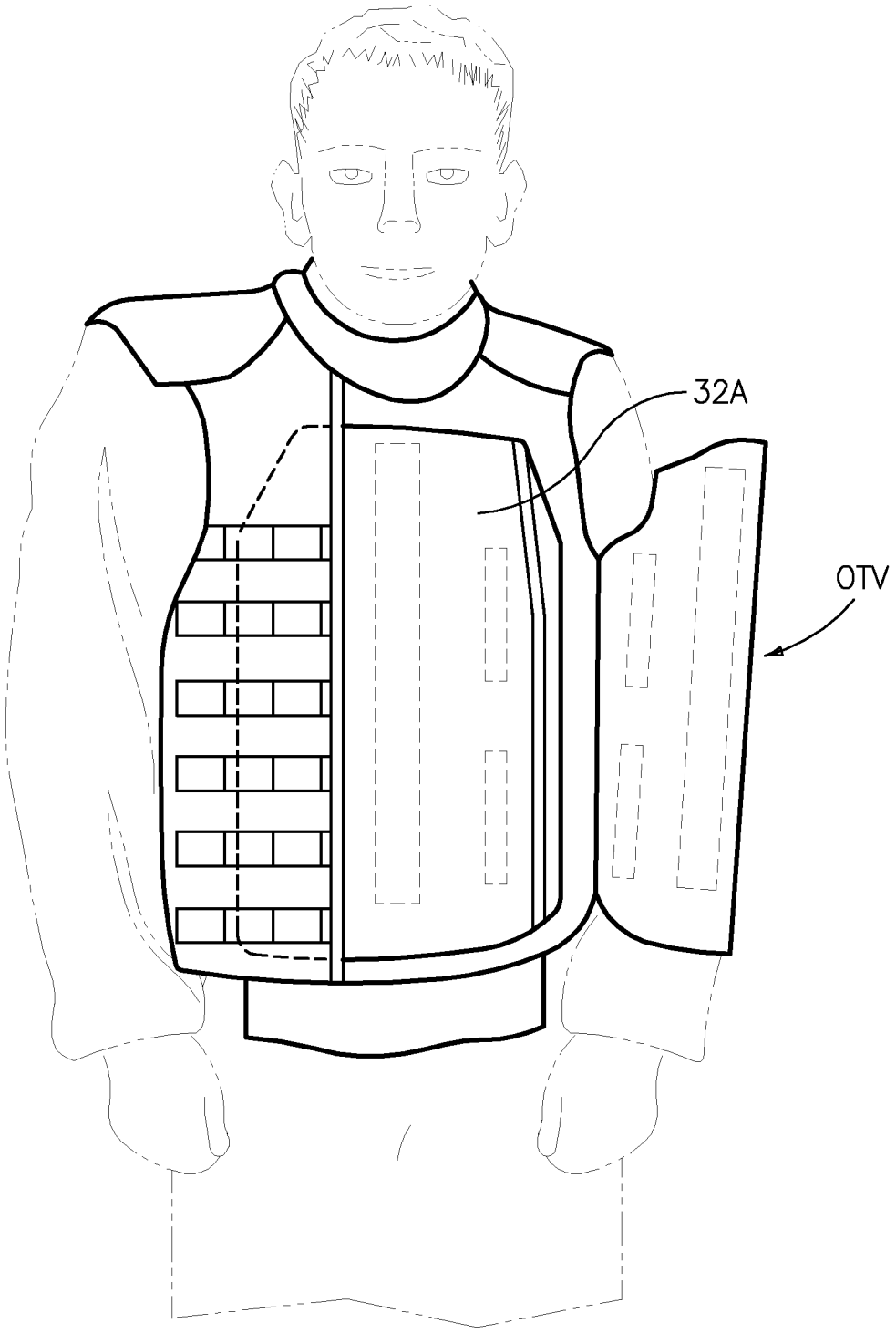
FIG. 4 is a perspective view of an armor system embodiment configured as a Small Arms Protective Inserts (SAPI) in an Outer Tactical Vest (OTV) of a personal body armor system.

Referring to FIG. 4, the armored panel 32A may be utilized with a personal body armor where the armored panel 32A is inserted into an Outer Tactical Vest (OTV) to augment the protection thereof in vital areas. The armored panels 32A of the present invention may be configured as Small Arms Protective Inserts (SAPI) which are removably retained at the front and back of the vest. It should be understood that armored panel 32A may be sized to fit within current personal body armor systems such as the Interceptor Body Armor system. It should be further understood that other armored panels 32A, such as side, neck, throat, shoulder, and groin protection may also be provided.

Figure 5:
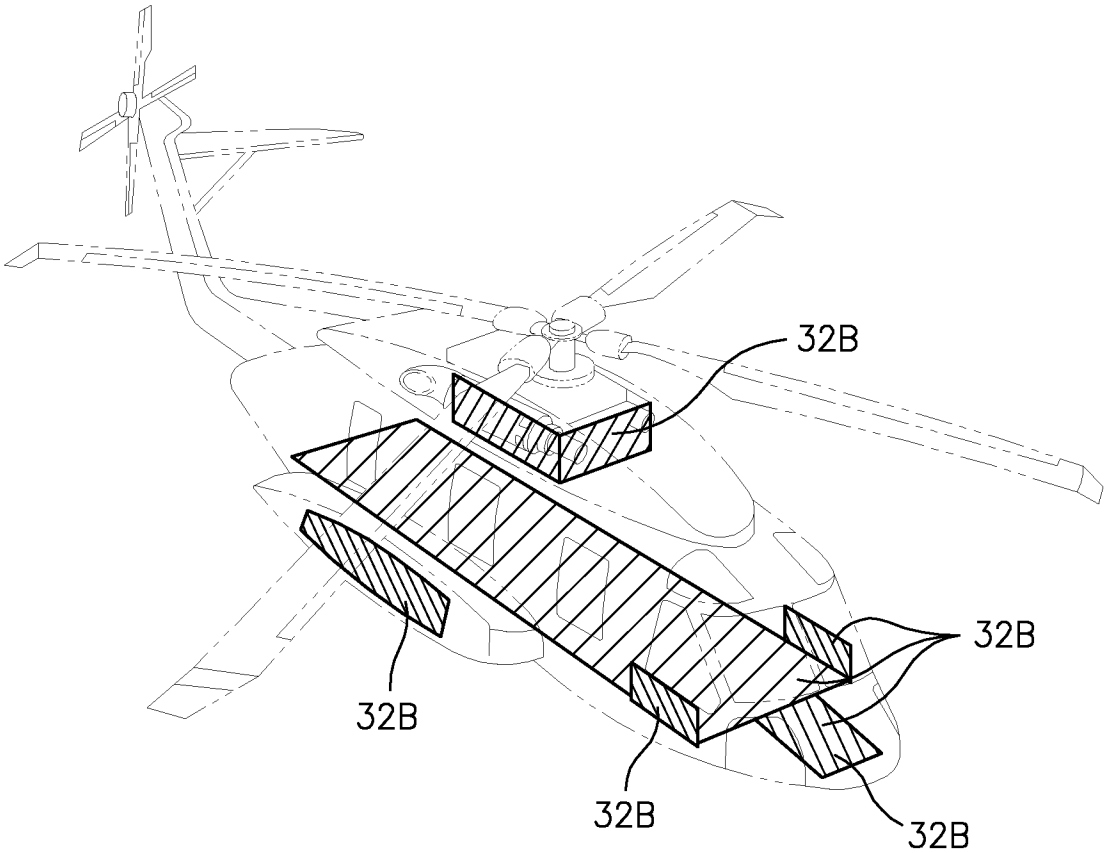
FIG. 5 is a perspective phantom view of an armor system embodiment which is applied over particular vital locations of a vehicle.

Referring to FIG. 5, the armored panel 32B is utilized as an armor system over vital locations of a vehicle. A multiple of the armored panels 32B are applied to provide a Ballistic Protection System (BPS) which may include add-on or integral armor to protect the vehicle. That is, the multiple of the armored panels 32B may be attached over or included within structure, such as doors, floors, walls, engine panels, fuel tanks areas and such like but need not be integrated into the vehicle structure itself. Although a particular helicopter configuration is illustrated and described in the disclosed embodiment, other configurations and/or machines, such as ground vehicles, sea vehicles, high speed compound rotary wing aircraft with supplemental translational thrust systems, dual contra-rotating, coaxial rotor system aircraft, turboprops, tilt-rotors and tilt-wing aircraft, will also benefit from the present invention.

The armored panel 32B may also be directly integrated into the vehicle load bearing structure such as being utilized an aircraft skin or other structures to provide ballistic protection and a more optimized lightweight solution to maximize mission capability. With the integration of armor into the vehicle structure itself, the ballistic protection of the occupants and crew is provided while the total weight of the armor-structure system may be reduced as compared to parasitic armor systems.

It should be appreciated that the armor system of the instant invention may be utilized in fixed wing aircraft, ground transportation vehicles, personal body armor, etc. and that various panel sizes, layer combinations and depth of layers may be utilized and specifically tailored to the desired element which is to be armor protected.

It should be understood that relative positional terms such as "forward," "aft," "upper," "lower," "above," "below," and the like are with reference to the normal operational attitude of the vehicle and should not be considered otherwise limiting.

It should be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The disclosed embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A hard ballistic material comprising:

a monolithic ceramic layer; and a rear face Ceramic Matrix Composite (CMC) layer continuously bonded to a rear face of said monolithic ceramic layer, wherein said rear face CMC layer includes one of (1) a ceramic matrix and (2) a glass matrix.

2. The hard ballistic material as recited in claim 1, wherein said rear face CMC layer includes a ceramic matrix hot pressed with said monolithic ceramic layer to continuously bond said rear face CMC layer to said monolithic ceramic layer.

3. The hard ballistic material as recited in claim 1, wherein said rear face CMC layer includes a glass matrix hot pressed with said monolithic ceramic layer to continuously bond said rear face CMC layer to said monolithic ceramic layer.

4. The hard ballistic material as recited in claim 1, wherein said rear face CMC layer is continuously bonded to said ceramic layer with an epoxy material.

5. The hard ballistic material as recited in claim 1, further comprising a front face CMC layer bonded to said monolithic ceramic layer through hot pressing, wherein said front face CMC layer includes one of (1) a ceramic matrix and (2) a glass matrix.

6. The hard ballistic material as recited in claim 1, further comprising a front face CMC layer bonded to said monolithic ceramic layer through an epoxy material, wherein said front face CMC layer includes one of (1) a ceramic matrix and (2) a glass matrix.

7. The hard ballistic material as recited in claim 1, further comprising a front face CMC layer bonded to a front face of said monolithic ceramic layer, wherein said front face CMC layer includes one of (1) a ceramic matrix and (2) a glass matrix.

8. The hard ballistic material as recited in claim 1, further comprising a compressed oriented fiber spall shield layer adjacent said rear face CMC layer.

9. The hard ballistic material as recited in claim 8, further comprising a front face CMC layer bonded to a front face of said monolithic ceramic layer to form an armor system, wherein said front face CMC layer includes one of (1) a ceramic matrix and (2) a glass matrix.

10. An armor system comprising:

a hard ballistic material layer comprising a monolithic ceramic layer; and a rear face Ceramic Matrix Composite (CMC) layer bonded to a rear face of said monolithic ceramic layer, wherein said rear face CMC layer includes one of (1) a ceramic matrix and (2) a glass matrix;

a compressed oriented fiber spall shield layer adjacent to a rear face of said hard ballistic material layer; and a backing layer adjacent to a rear face of said compressed oriented fiber spall shield layer.

11. The armor system as recited in claim 10, further comprising a front face layer, said backing layer bonded to said front face layer to encapsulate said hard ballistic material layer and said compressed oriented fiber spall shield layer.

12. The armor system as recited in claim 11, wherein said backing layer is bonded to said front face layer along an edge of said hard ballistic material layer.

13. The armor system as recited in claim 10, further comprising a front face CMC layer bonded to a front face of said monolithic ceramic layer, wherein said front face CMC layer includes one of (1) a ceramic matrix and (2) a glass matrix.

14. The armor system as recited in claim 10, further comprising a spacer layer intermediate said compressed oriented fiber spall shield layer and said backing layer.

15. An armor system comprising:

a front face layer;

a hard ballistic material layer, including:

a monolithic ceramic layer bonded to said front face layer; and a rear face Ceramic Matrix Composite (CMC) layer bonded to a rear face of said monolithic ceramic layer, wherein said rear face CMC layer includes one of (1) a ceramic matrix and (2) a glass matrix;

a compressed oriented fiber spall shield layer bonded to a rear face of said hard ballistic material layer;

a spacer layer bonded to a rear face of said compressed oriented fiber spall shield layer; and a backing layer bonded to said spacer layer.

16. The armor system as recited in claim 15, further comprising a front face layer, said backing layer bonded to said front face layer to encapsulate said hard ballistic material layer and said compressed oriented fiber spall shield layer.

17. The hard ballistic material as recited in claim 1 wherein a compressive stress wave from a projectile impact is reflected as a tensile stress wave from said rear face CMC layer.

* * * * *